US010392774B2

(12) United States Patent
Dauderman

(10) Patent No.: US 10,392,774 B2
(45) Date of Patent: Aug. 27, 2019

(54) POSITION CONTROL SYSTEM AND METHOD FOR AN IMPLEMENT OF A WORK VEHICLE

(71) Applicant: Deere & Company, Moline, IL (US)

(72) Inventor: Bradley C. Dauderman, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 108 days.

(21) Appl. No.: 15/797,283

(22) Filed: Oct. 30, 2017

(65) Prior Publication Data

US 2019/0127949 A1 May 2, 2019

(51) Int. Cl.

| | |
|---|---|
| ***E02F 3/84*** | (2006.01) |
| ***E02F 9/20*** | (2006.01) |
| ***E02F 9/22*** | (2006.01) |
| ***F15B 13/042*** | (2006.01) |
| ***E02F 3/76*** | (2006.01) |
| ***F15B 13/044*** | (2006.01) |
| ***F15B 13/04*** | (2006.01) |

(52) U.S. Cl.

CPC ..... *E02F 3/844* (2013.01); *E02F 3/7609* (2013.01); *E02F 9/2004* (2013.01); *E02F 9/2228* (2013.01); *E02F 9/2267* (2013.01); *E02F 9/2271* (2013.01); *F15B 13/0402* (2013.01); *F15B 13/0424* (2013.01); *F15B 13/0442* (2013.01)

(58) Field of Classification Search

CPC ..... E02F 3/844; E02F 3/7609; E02F 3/7613; E02F 3/7618; E02F 9/2203; E02F 9/2228; E02F 9/2285; E02F 9/2292; E02F 9/2217; E02F 9/226; E02F 9/2004; E02F 9/2267; E02F 9/2271; F15B 1/024; F15B 11/024; F15B 13/0402; F15B 13/0424; F15B 13/0442

USPC ..... 37/347, 348; 60/468; 91/436, 448, 451, 91/445, 461, 446; 172/1–11; 701/50

See application file for complete search history.

(56) References Cited

U.S. PATENT DOCUMENTS

| | | | |
|---|---|---|---|
| 4,139,066 | A | 2/1979 | Goodney et al. |
| 4,986,377 | A | 1/1991 | Moriarty |
| 5,014,734 | A | 5/1991 | Smith |

(Continued)

FOREIGN PATENT DOCUMENTS

WO 2009071264 A1 6/2009

*Primary Examiner* — Robert E Pezzuto

(74) *Attorney, Agent, or Firm* — Taft Stettinius & Hollister LLP; Stephen F. Rost

(57) ABSTRACT

A position control system for an implement of a work vehicle. The implement, such as a blade, is operatively connected to a push arm rotatably coupled to a frame of the work vehicle. A hydraulic actuator is operatively connected to the push arm and is configured to adjust the position of the push arm with respect to the frame. A controller generates a control command to adjust the position of the hydraulic actuator to thereby raise and lower the blade. A proportional quick drop valve, coupled to the hydraulic actuator and to the controller, directs a flow of fluid to the hydraulic actuator in response to the operator control command. The proportional quick drop valve reduces a drop speed of the blade, reduces cavitation of the actuator valves, and also reduces the pressure drop and fluid flow forces acting on the spools of the actuator valves.

20 Claims, 4 Drawing Sheets

(56) References Cited

U.S. PATENT DOCUMENTS

| | | | | |
|---|---|---|---|---|
| 5,226,348 | A * | 7/1993 | Dezelan | F15B 11/024 91/436 |
| 5,907,991 | A * | 6/1999 | Ramamoorthy | E02F 9/2203 91/436 |
| 6,041,871 | A | 3/2000 | Defty | |
| 6,247,540 | B1 | 6/2001 | Clemen et al. | |
| 6,609,622 | B2 * | 8/2003 | Forsyth | B66C 23/44 180/9.52 |
| 6,699,311 | B2 * | 3/2004 | Smith | E02F 3/844 91/436 |
| 7,913,491 | B2 | 3/2011 | Lin et al. | |
| 8,047,121 | B2 * | 11/2011 | Yamamoto | E02F 3/844 91/436 |
| 8,225,706 | B2 | 7/2012 | Vigholm et al. | |
| 8,649,944 | B2 | 2/2014 | Hayashi et al. | |
| 9,026,319 | B2 | 5/2015 | Hayashi et al. | |
| 9,074,347 | B2 | 7/2015 | Vigholm et al. | |
| 9,222,236 | B2 | 12/2015 | Ishibashi et al. | |
| 9,903,096 | B2 * | 2/2018 | Noborio | G01S 19/49 |

* cited by examiner

POSITION CONTROL SYSTEM AND METHOD FOR AN IMPLEMENT OF A WORK VEHICLE

FIELD OF THE DISCLOSURE

The present invention generally relates to a position control system and method for an implement of a work vehicle, and more particularly to a position control system and method for a blade of a bulldozer.

BACKGROUND

Work vehicles are configured to perform a wide variety of tasks for use as construction vehicles, forestry vehicles, lawn maintenance vehicles, as well as on-road vehicles such as those used to plow snow, spread salt, or vehicles with towing capability. Additionally, work vehicles such as a bulldozer, may be equipped with bulldozer blades for pushing dirt and other materials. It is desirable to adjust the position the blade for different operations and conditions. On utility crawler dozers, the blade is typically adjustable in different directions, which includes raising and lowering of the blade, adjusting a pitch position of the blade by moving the top portion of the blade forward and backward relative to a lower pivot point, and an angle of the blade by moving the blade left or right about a center pivot point.

Currently, a hydraulic control valve is used to raise and lower the blade. A spool valve is shifted to direct oil flow to each side of a hydraulic cylinder coupled to the frame and to the blade. A quick drop valve is plumbed in series with the spool valve, and when an operator desires to lower the blade quickly, the quick drop valve is activated to connect the rod end of the cylinder (return flow during lower) to the head of the cylinder.

The quick drop valve is an on/off valve that connects both ends of the cylinder together to regenerate oil and to provide a fast drop speed. On a crawler dozer, the blade lower function is usually the highest velocity function. The blade lower return flow usually ends up dictating the control valve size and is a limiting factor. The rapid descent of the blade, however, generates undesirable forces on the quick drop valve and the hydraulic cylinder that can reduce the life of these devices as well as increase the amount of repair and maintenance required to maintain the blade adjustment system. This rapid descent also increases the likelihood of cavitation which can damage the quick drop valve and cylinders. What is needed therefore is position control system and method for an implement of a work vehicle to reduce and/or eliminate damage and repair costs to implement lowering systems.

SUMMARY

The present invention incorporates a proportionally controlled valve that starts opening before the "quick drop" function is needed. During a normal blade lower proportional metering of the valve, a proportional current command begins to open the proportional quick drop valve to allow metered return fluid flow through the quick drop valve instead, of having to return to reservoir through a main control valve. This reduces cavitation by providing additional flow to the head of cylinder. It also helps reduce pressure drop and flow forces acting on the spool of the main control valve through the return metering notches located in the spool of a hydraulic spool valve.

In one embodiment, there is provided a blade adjusting system for a blade of a work vehicle having a frame and an operator control device generating a valve command to adjust a position of the blade with respect to the frame. The system includes a hydraulic actuator operatively connected to the blade and to the operator control device, wherein the hydraulic actuator is configured to adjust the position of the blade with respect to the frame in response to the valve command of the operator control device. An actuator valve is operatively connected to the hydraulic actuator and is configured to adjust a position of the hydraulic actuator in response to the valve command, wherein the actuator includes a fully closed position and a fully open position. A proportional quick drop valve is operatively connected to the hydraulic actuator, wherein the proportional quick drop valve is configured to direct a flow of fluid to the hydraulic actuator in response to the valve command of the operator control when the actuator valve is between the fully closed position and the fully open condition.

In another embodiment, there is provided a crawler dozer including a blade operatively connected to and configured to be raised and lowered with respect to a frame of the crawler dozer. The crawler dozer includes a push arm rotatably coupled to the frame wherein the blade is rotatably coupled to the push arm and a hydraulic actuator operatively connected to the push arm. The hydraulic actuator is configured to adjust the position of the push arm with respect to the frame. An operator control device is operatively connected to the hydraulic actuator and is configured to generate an operator control command to adjust the position of the hydraulic actuator. An actuator valve is operatively connected to the hydraulic actuator and is configured to adjust a position of the hydraulic actuator in response to the operator control command, wherein the actuator includes a fully closed position and a fully open position. A proportional quick drop valve is operatively connected to the hydraulic actuator and to the operator control device, wherein the proportional quick drop valve is configured to direct a flow of fluid to the hydraulic actuator in response to the operator control command when the actuator valve is between the fully closed position and the fully open position.

In still another embodiment, there is provided a method of adjusting a position of blade of a work vehicle, wherein the work vehicle includes a push arm operatively connected to the blade and a hydraulic actuator having a rod end and a head end. The hydraulic actuator is operatively connected to the push arm wherein the hydraulic actuator adjusts the position of the push arm in response to an operator command provided by an operator control device. The method includes: providing a proportional control valve operatively connected to the hydraulic actuator; providing an actuator valve operatively connected to the hydraulic actuator, the actuator valve including a fully closed position and a fully open position; generating an operator command in response to an input received from the operator control device; and adjusting the proportional control valve in response to the operator command if the actuator valve is between the fully closed position and the fully open position and if the operator command exceeds a predetermined threshold to provide a fluid flow between the rod end and the head end of the hydraulic actuator.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

DETAILED DESCRIPTION

Figure 1:
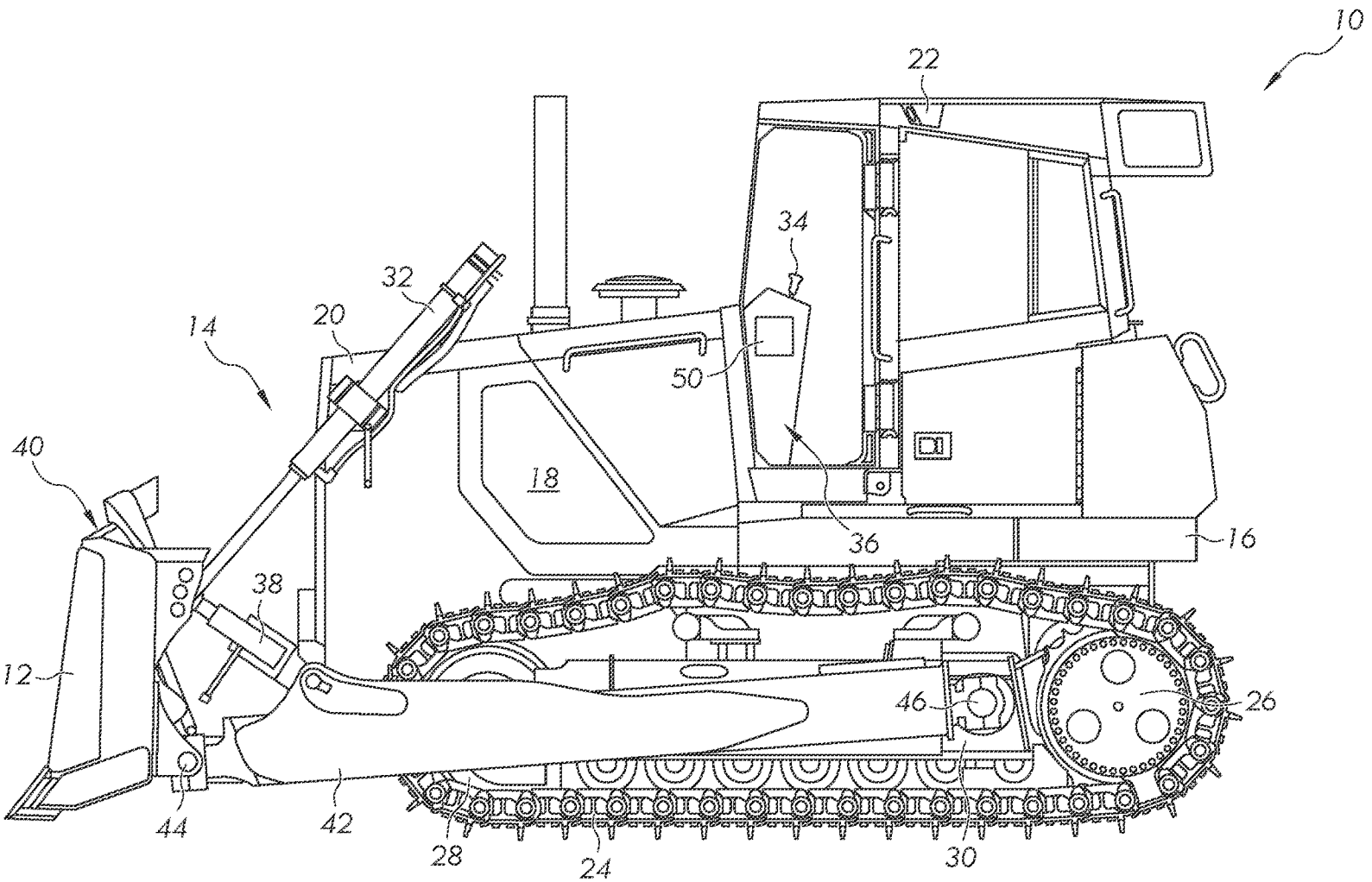
FIG. 1 is an elevational side view of a work vehicle, and more specifically, of a bulldozer such as a crawler dozer including a blade.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

FIG. 1 is an elevational side view of a work vehicle 10, such as a crawler bulldozer, including an implement, such as a bulldozer blade 12, which is suitably coupled to the dozer by a linkage assembly 14. The vehicle includes a frame 16 which houses an internal combustion engine 18 located within a housing 20. The work vehicle 10 includes a cab 22 where an operator sits or stands to operate the vehicle. The vehicle is driven by a belted track 24 which operatively engages a rear main drive wheel 26 and a front auxiliary drive wheel 28. The belted track is tensioned by tension and recoil assembly 30. The belted track is provided with centering guide lugs for guiding the track across the drive wheels, and grousers for frictionally engaging the ground.

While the described embodiments are discussed with reference to a crawler bulldozer, other work vehicles are contemplated including other types of construction vehicles, forestry vehicles, lawn maintenance vehicles, as well as on-road vehicles such as those used to plow snow.

The main drive wheels 26 are operatively coupled to a steering system which is in turn coupled to a transmission. The transmission is operatively coupled to the output of the internal combustion engine 18. The steering system may be of any conventional design and maybe a clutch/brake system, hydrostatic, or differential steer. The transmission may be a power shift transmission having various clutches and brakes that are actuated in response to the operator positioning a shift control lever (not shown) located in the cab 22.

The bulldozer blade 12 is raised and lowered by actuators 32, such as hydraulic cylinders. While one actuator 32 is shown in FIG. 1, two actuators 32 are operatively connected to the blade 12 as is understood by one skilled in the art. One or more control devices 34, located at a user interface of a workstation 36 are accessible to the operator located in the cab 22. The blade 12 is tilted by actuators 38, such as hydraulic actuators, which adjust a tilt angle of the blade 12 moving an upper portion 40 of the blade 12 toward or away from the frame 16. Additional actuators (see angle cylinders 52 of FIG. 2) move the blade 12 left or right of a center longitudinal axis of the vehicle 10. The extension and retraction of the hydraulic cylinders is controlled by the operator through the control devices 34.

The control devices 34 are located at a user interface that includes a plurality of operator selectable buttons configured to enable the operator to control the operations and functions of the vehicle 10. The user interface, in one embodiment, includes a user interface device including a display screen having a plurality of user selectable buttons to select from a plurality of commands or menus, each of which are selectable through a touch screen having a display. In another embodiment, the user interface includes a plurality of mechanical push buttons as well as a touch screen. In still another embodiment, the user interface includes a display screen and only mechanical push buttons. In one or more embodiments, adjustment of blade with respect to the frame is made using one or more levers or joysticks.

Extension and retraction of the actuators 32 raises or lowers the blade 12 with respect to ground or another surface upon which the vehicle 10 is located. The blade 12 is rotatably coupled to a push arm 42 at a rotational axis 44 at one end of the push arm. The push arm 42 is rotatably coupled to the frame 16 at a rotational axis 46. Extension or retraction of the actuators 32 moves the blade 12 up or down as the push arm 42 rotates about the rotational axis 46.

Figure 2:
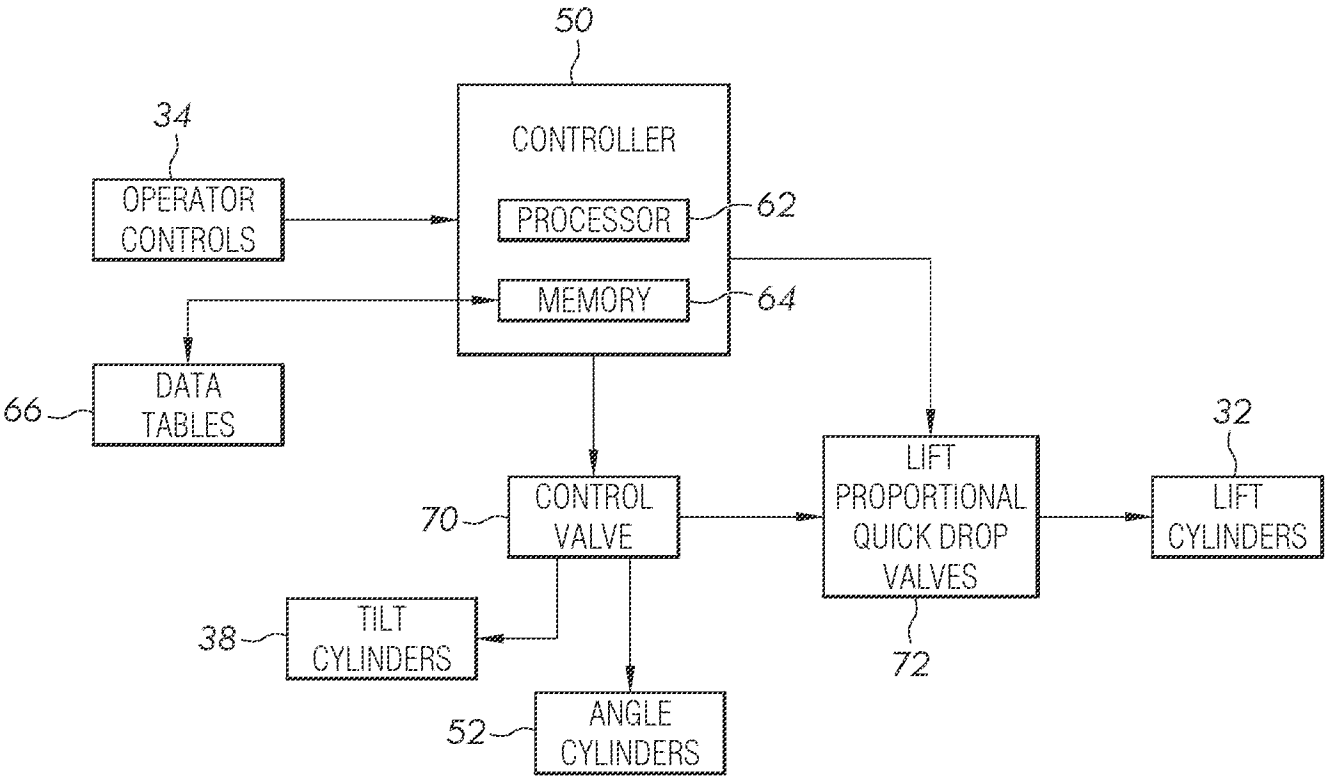
FIG. 2 is a schematic block diagram of a control system configured to adjust the position of the blade.

Adjustment of the actuators is made by the operator using the controls 34 which are operably coupled to a controller 50, as seen in FIG. 2, which in one embodiment, is located at the workstation 36. In other embodiments, the controller 50 is located at other locations of the work vehicle. As can be seen in FIG. 2, the operator control devices 34 are operatively connected to the controller 50 which is operatively to the tilt cylinders 38, angle cylinders 52, and to the lift cylinders 32.

The controller 50, in one or more embodiments, includes a processor 62 operatively connected to a memory 64. In still other embodiments, the controller 50 is a distributed controller having separate individual controllers distributed at different locations on the vehicle 10. In addition, while the controller is generally hardwired by electrical wiring or cabling to related components, in other embodiments the controller 50 includes a wireless transmitter and/or receiver to communicate with a controlled or sensing component or device which either provides information to the controller or transmits controller information to controlled devices.

The controller 50, in different embodiments, includes a computer, computer system, or other programmable devices. In other embodiments, the controller 50 includes one or more processors 62 (e.g. microprocessors), and the associated memory 64, which can be internal to the processor or external to the processor. The memory 64 can include random access memory (RAM) devices comprising the memory storage of the controller 50, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to controller 50. The mass storage device can include a cache or other dataspace which can include databases. Memory storage, in other embodiments, is located in the "cloud", where the memory is located at a distant location which provides the stored information wirelessly to the controller 50.

The controller 50 executes or otherwise relies upon computer software applications, components, programs, objects, modules, or data structures, etc. Software routines resident in the included memory of the controller 50 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices that execute the instructions resident in memory, which are responsive to other instructions generated by the system, or which are provided at a user interface operated by the user. The processor 62 is configured to execute the stored program instructions as well as to access data stored in one or more data tables 66.

The height of the blade 12 is adjusted by the extension and retraction of linear hydraulic actuators 32 which respond to movement of the operator control 34, such as a joystick. The joystick generates a command signal that is received by the controller 50, which determines the commanded position of the blade and generates a lift control command signal transmitted to an actuator lift control valve 70 and a proportional quick drop command signal transmitted to lift proportional quick drop valves 72. Each of the lift cylinders 32 is operatively connected to one of the actuator control valves 70 and to the lift proportional quick drop valve 72.

Figure 3:
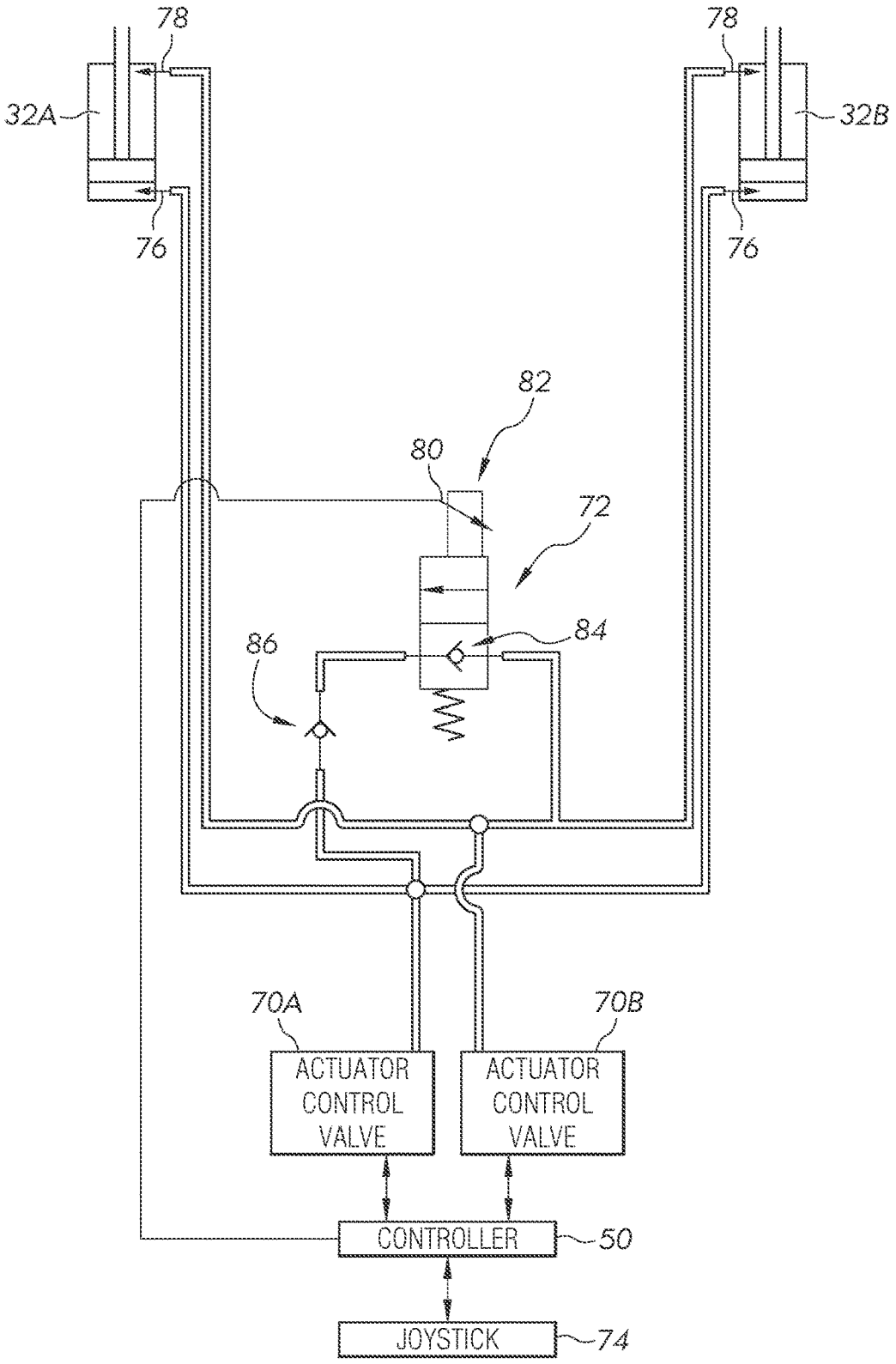
FIG. 3 is a block diagram of a proportional quick drop valve configured to adjust the position of the blade.

As further illustrated in FIG. 3, a joystick 74, one of the operator controls 34 is operatively connected each of the actuator control valves 70A and 70B through the controller 50. Each of the control valves 70A and 70B are in turn operatively connected to cylinder 32A and cylinder 32B. The valve 70A is operatively connected to a piston port 76 of each of the cylinders 32A and 32B and the valve 70B is operatively connected to a rod port 78 of each of the cylinders 32A and 32B. Fluid pressure at the piston ports 76 lower the blade 12 the rod and fluid pressure at rod ports 78 raises the blade 12. The proportional quick drop valve 72 is operatively connected to both the control valves 70A and 70B.

In one embodiment of the vehicle 10, pulling the joystick 74 rearward toward the operator raises the blade 12. The blade 12 is lifted more quickly as the joystick 74 is moved further rearward. To lower the blade 12, the joystick 74 is moved forward away from the operator. The blade lowers more quickly as the joystick 74 is moved further forward. The joystick moves through a plurality of positions between a first position of zero displacement of the joystick, where the blade is not moved, and a second position of one-hundred percent displacement where the blade is moved to a maximum location.

The proportional quick drop valve 72 is a solenoid operated normally closed two position valve. Solenoid control of the valve is provided by the controller 50 transmitting a command signal to a solenoid input 80 of a solenoid 82. In different embodiments, the control valve 72 includes a solenoid as an integral component of the valve or the solenoid is a separate device operatively connected to a two way valve. The control valve 72 is a spring return valve in which a spring forces the valve to be normally closed. As the solenoid receives command signals to adjust the position of an internally located spool, the spring compresses when the solenoid receives command signals from the controller 50.

The valve 72 further includes a normally closed valve 84 which prevents the flow of fluid in a single direction. In this embodiment, fluid flow is restricted from moving right to left as illustrated. A second normally closed valve 86 is operatively coupled between the lift control valve 70A and the normally closed valve 84. Fluid flow is restricted from moving toward the normally closed valve 84. Each of the valves 84 and 86 substantially prevent fluid from leaking from the head end of the cylinders 32A and 32B located at the ports 76.

On a bulldozer, a blade lowering operation is typically the highest velocity function, when compared to other blade control function such as raising the blade or adjusting the tilt of the blade. The amount of return fluid flow for lowering the blade typically dictates the size of the control valves 70, as it is considered a limiting factor. To overcome these limiting factors, the present invention includes the proportional control valve 72, which is commanded to start opening after a blade lowering or "quick drop" function is started. By using the proportional valve 72 for a blade lowering function, controlling (metering) the flow of fluid to the cylinders 32A and 32B, reduces or eliminates the disadvantage that result when using a standard quick drop valve. Upon actuation by the joystick 74 to lower the blade 12, a current command is provided by the controller 50 the actuator control valves 70A and 70B. Upon receipt of the command, the actuator control valves 70A and 70B provide fluid to the actuators 32A and 32B to start lowering the blade 12. Once the blade 12 starts to drop, a current command provided by the controller 50 to the solenoid input 80 starts to open the proportional quick drop valve 72. The valve 72 starts to open after the cylinders 32A and 32B are commanded to move by valves 70A and 70B. The current command to the solenoid 80 starts a metered return flow of fluid through the quick drop valve 72, instead of having the fluid return to a fluid reservoir through the actuator control valves 70. The start of fluid flow through the proportional quick drop valve 72 is a lower drop speed of the blade, when compared to the conventional on/off quick drop valve that is completely opened in response to an operator command to drop the implement. In addition, cavitation is reduced by providing additional flow to the heads of cylinders located at the ports 76. This fluid flow enabled by valve 72 also reduces pressure drop and fluid flow forces acting on the main control valve spools 70 through the return metering notches.

When the joystick 74 starts to move in response to actuation by the operator, the joystick 74 transmits a command signal to the controller 50. In one embodiment, the controller 50 is a dedicated hydraulic controller configured to control only the hydraulics of the vehicle 10. In other embodiments, the controller 50 is part of a controller providing other functions, in addition to hydraulic functions. Each of these command signals provided by the controller 50 is based on a lookup table stored in the data tables 66 for metering of the control valves 70 and metering of the proportional quick drop valve 72. The valve command for the control valves 70 is determined from a stored look up table storing data values of joystick positions and corresponding valve commands. For instance, each position of the joystick provides a different value of a joystick current command which is related to a corresponding valve current command to adjust the position of the spools of each of the valves 70A and 70B.

A quick drop command for transmitting to the solenoid input 80 is stored in the look up table that stores data values of valve commands and a corresponding proportional quick drop command for each valve command to adjust the position of the solenoid 72. In one embodiment, the proportional quick drop valve command is not transmitted to the solenoid 82 until the transmitted control valve command adjusts the spool of the control valve to a position of approximately fifty (50) percent (%). Once the control valves 70A and 70B reach about the 50% position, the command signal transmitted to the solenoid 82 starts to open the proportional control valve 72 to start a recirculation of fluid flow from the rod ends to the head ends of each of the cylinders 32A and 32B. The current commands to the control valves 70A and 70B shifts the spools of each, which sends oil through the proportional quick drop valve 72 and to the cylinders 32A and 32B. As the proportional quick drop valve 72 is opened, the resulting fluid flow provides for fluid flow from the rod ends at ports 78 to recirculate back into the head ends at ports 76.

The command signal transmitted by the controller 50 to the proportional quick drop valve 72 is a variable command signal representative of the position of the joystick 50. As the joystick 50 directs the valves 70A and 70B to open more fully, the proportional quick drop valve 72 opens further, proportionally increasing the flow through the valve 72. The more current supplied by the command signal, the further the spool of the valve 72 shifts.

In one embodiment, each of the actuator valves includes a spool having a plurality of partially opened positions between a fully closed position and a fully opened position. The proportional quick drop valve includes a spool having a plurality of partially opened positions between a fully closed position and a fully opened position. In one embodiment, the partially opened positions of each of the spools are not determined as discrete positions, but are continuous positions based on a continuous flow of fluid.

Figure 4:
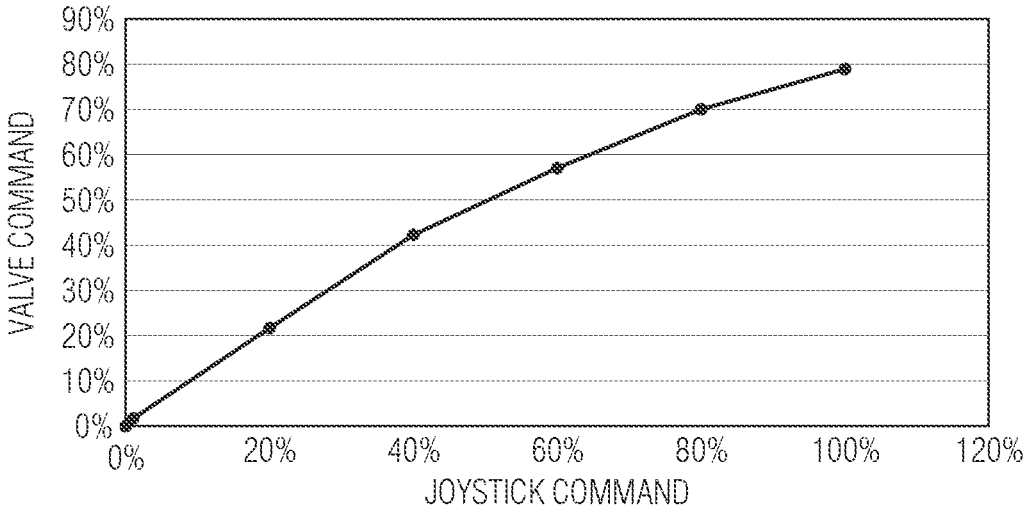
FIG. 4 is a graph representing valve command values based on joystick command values.

As seen in the graph of FIG. 4, each joystick command determines a corresponding valve command. For instance, if the joystick is located at approximately 40%, the joystick command is configured to position the valve spool at approximately 40% of being completely open. At a joystick position of 100%, the joystick command is configured to position the valve spool at approximately 80% of being completely open. The joystick command values, presented as percentages, are converted to actual valve commands such that the lookup table includes a correlated set of values between the joystick commands and the valve commands, such that the sensed position of the joystick enables the controller to adjust the position of the valve to the predetermined position based on the joystick command. While the graph represents one embodiment of values used to populate the lookup table, in other embodiments, other locations of the valve spool based on the joystick command are contemplated. In addition, it is contemplated that the relationship between joystick commands and valve commands in different embodiments is either linear or nonlinear.

Figure 5:
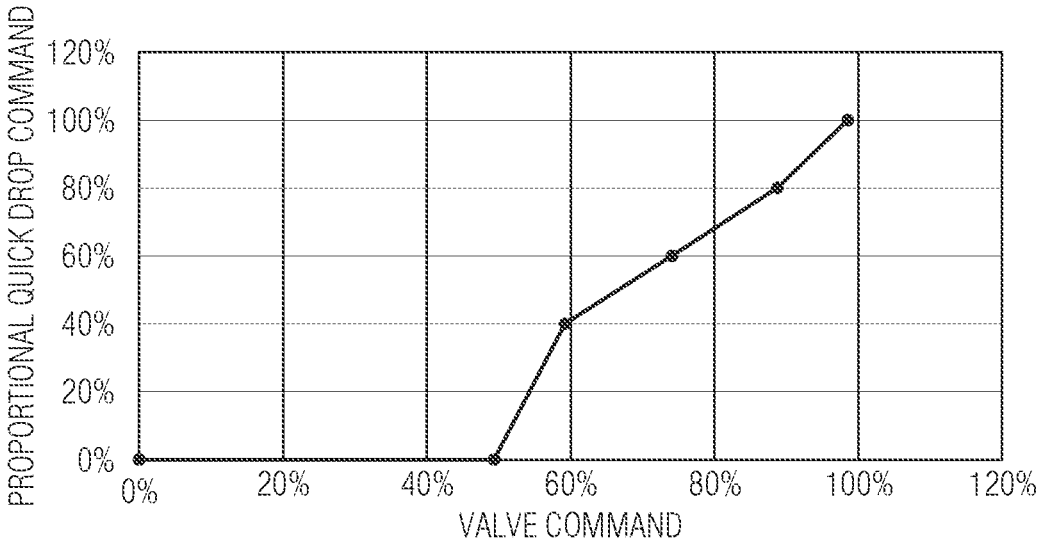
FIG. 5 is a graph representing proportional quick drop valve command values versus valve command values.

Once the appropriate valve command is determined from the lookup table, that valve command is used to determine an appropriate proportional quick drop command as seen in FIG. 5. For instance, a valve command of 40% provides a proportional quick drop command of 0%. Beginning at a valve command of approximately 50% (a predetermined threshold value), the proportional quick drop valve is commanded to start enabling fluid flow from the rod ends at ports 78 to recirculate back into the head ends at ports 76. Once the valve command exceeds 50%, the associated quick drop command increases the fluid flow until a valve command of 100% provides a proportional quick drop command of 100%. While FIG. 5 illustrates one embodiment of a values stored in a lookup table having proportional quick drop commands based on the valve commands, other relational values of proportional quick drop commands based on valve commands are contemplated. For instance, in another embodiment a valve command of 40% provides a proportional quick drop command that starts to open the quick drop valve. In addition, it is contemplated that the relationship between proportional quick drop commands and valve commands in different embodiments once the threshold value is reached is either linear or nonlinear.

As illustrated in FIG. 5, the proportional quick drop valve begins to open before the actuator valve has opened completely. This is in contrast to the known conventional system in which a quick drop valve does not open until a "quick drop" function is needed: i.e. not until the actuator valve has opened completely. By commanding the proportional quick drop valve to start allowing metered return fluid to flow through the proportional quick drop valve before the actuator valve has completely opened, cavitation in the actuating cylinders is reduced, and flow forces on the actuator valve are reduced.

While exemplary embodiments incorporating the principles of the present disclosure have been described hereinabove, the present disclosure is not limited to the described embodiments. Instead, this application is intended to cover any variations, uses, or adaptations of the disclosure using its general principles. In addition, while the terms greater than and less than have been used in making comparison, it is understood that either of the less than or greater than determines can include the determination of being equal to a value. Further, this application is intended to cover such departures from the present disclosure as come within known or customary practice in the art to which this disclosure pertains and which fall within the limits of the appended claims.

The invention claimed is:

1. A blade adjusting system for a blade of a work vehicle having a frame and an operator control device generating a valve command to adjust a position of the blade with respect to the frame, the system comprising:

a hydraulic actuator operatively connected to the blade and to the operator control device, wherein the hydraulic actuator is configured to adjust the position of the blade with respect to the frame in response to the valve command of the operator control device;

an actuator valve operatively connected to the hydraulic actuator configured to adjust a position of the hydraulic actuator in response to the valve command, wherein the actuator valve includes a fully closed position and a fully open position; and a proportional quick drop valve operatively connected to the hydraulic actuator, wherein the proportional quick drop valve is configured to direct a flow of fluid to the hydraulic actuator in response to the valve command of the operator control when the actuator valve is between the fully closed position and the fully open position.

2. The blade adjusting system of claim 1 wherein the actuator valve is operatively connected to the operator control device and is configured to adjust a position of the hydraulic actuator in response to the valve command.

3. The blade adjusting system of claim 2 wherein the actuator valve includes a spool having a plurality of partially opened positions between the fully closed and the fully open positions and the proportional quick drop valve includes a spool having a plurality of partially opened positions between fully closed and fully open positions, and further wherein the fully closed position of the proportional quick drop valve occurs when the spool of the actuator valve is at one of the plurality of partially opened positions.

4. The blade adjusting system of claim 2 further comprising a controller including a processor and a memory, the controller operatively connected to the actuator valve and to the proportional quick drop valve, wherein the memory is configured to store program instructions, actuator valve commands, and proportional quick drop valve commands, and the processor is configured to execute the stored program instructions to:

determine a value of an actuator valve command generated by the operator control device;

determine whether the determined actuator valve command value exceeds a predetermined value;

determine a value of one of the proportional quick drop valve commands if the determined valve command value exceeds the predetermined value;

transmit the determined value of the proportional quick drop valve command to the proportional quick drop valve if the determined actuator valve command exceeds the predetermined value; and adjust the position of the hydraulic actuator based on the determined actuator valve command and the proportional quick drop valve command.

5. The blade adjusting system of claim 4 wherein the proportional quick drop valve includes a solenoid operated control valve, wherein the solenoid operated control valve is operatively connected to the controller and is configured to receive the proportional quick drop valve commands in response to actuation of the operator control device.

6. The blade adjusting system of claim 4 wherein the operator control device is a joystick configured to generate a joystick command, wherein the joystick command includes a first position of a zero blade displacement and a second position of a one-hundred percent blade displacement.

7. The blade adjusting system of claim 6 wherein the determined value of the actuator valve command is based on a joystick command generated by the joystick.

8. The blade adjusting system of claim 7 wherein the memory is further configured to store at least one lookup table including a plurality of the actuator valve commands based on a plurality of joystick commands, wherein a selected one of the plurality of joystick commands determines a corresponding selected one of the plurality of actuator valve commands.

9. The blade adjusting system of claim 8 wherein the at least one lookup table includes a plurality of the proportional quick drop valve commands based on the plurality of actuator valve commands, wherein a selected one of the plurality of actuator valve commands determines a corresponding selected one of the plurality of proportional quick drop valve commands.

10. The blade adjusting system of claim 9 wherein at least one of the plurality of valve commands includes a value of other than zero and an associated one of the plurality of proportional quick drop valve commands is equal to zero such that the valve command of other than zero does not trigger a proportional quick drop valve command.

11. A crawler dozer including a blade operatively connected and configured to be raised and lowered with respect to a frame of the crawler dozer, the crawler dozer comprising:

a push arm rotatably coupled to the frame wherein the blade is rotatably coupled to the push arm;

a hydraulic actuator operatively connected to the push arm, wherein the hydraulic actuator is configured to adjust the position of the push arm with respect to the frame;

an operator control device operatively connected to the hydraulic actuator and configured to generate an operator control command to adjust the position of the hydraulic actuator;

an actuator valve operatively connected to the hydraulic actuator configured to adjust a position of the hydraulic actuator in response to the operator control command, wherein the actuator valve includes a fully closed position and a fully open position; and a proportional quick drop valve operatively connected to the hydraulic actuator and to the operator control device, wherein the proportional quick drop valve is configured to direct a flow of fluid to the hydraulic actuator in response to the operator control command when the actuator valve is between the fully closed position and the fully open position.

12. The crawler dozer of claim 11 wherein the actuator valve is operatively connected to the operator control device and the actuator valve is configured to adjust a position of the hydraulic actuator in response to the operator control command.

13. The crawler dozer of claim 12 wherein the actuator valve includes a spool having a plurality of partially opened positions between a fully closed position and a fully opened position and the proportional quick drop valve includes a spool having a plurality of partially opened positions between a fully closed position and a fully opened position, and further wherein the fully closed position of the proportional quick drop valve occurs when the spool of the actuator valve is at one of the plurality of partially opened positions.

14. The crawler dozer of claim 12 further comprising a controller including a processor and a memory, the controller operatively connected to the actuator valve and to the proportional quick drop valve, wherein the memory is configured to store program instructions, actuator valve commands, and proportional quick drop valve commands, and the processor is configured to execute the stored program instructions to:

determine a value of an actuator valve command generated in response to the operator control command;

determine whether the determined actuator valve command value exceeds a predetermined value;

determine a value of a proportional quick drop valve command if the determined valve command value exceeds the predetermined value;

transmit the determined value of the proportional quick drop valve command to the proportional quick drop valve if the determined actuator valve command exceeds the predetermined value; and adjust the position of the hydraulic actuator with the actuator valve, wherein the position is based on the determined actuator valve command and the proportional quick drop valve command.

15. The crawler dozer of claim 14 wherein the proportional quick drop valve includes a solenoid operated control valve, wherein the solenoid operated control valve is operatively connected to the controller and is configured to receive the proportional quick drop valve command in response to actuation of the operator control device.

16. The crawler dozer of claim 14 wherein the operator control device is a joystick configured to generate a joystick command, wherein the joystick command includes a first position of zero displacement and a second position of a one-hundred percent displacement.

17. The crawler dozer of claim 16 wherein the determined value of the actuator valve command is based on a joystick command generated by the joystick.

18. The crawler dozer of claim 17 wherein the memory is further configured to store at least one lookup table including a plurality of the actuator valve commands based on a plurality of joystick commands, wherein a selected one of the plurality of joystick commands determines a corresponding selected one of the plurality of actuator valve commands.

19. A method of adjusting a position of a blade of a work vehicle, the work vehicle including a push arm operatively connected to the blade and a hydraulic actuator having a rod end and a head end, the hydraulic actuator operatively connected to the push arm wherein the hydraulic actuator adjusts the position of the push arm in response to an operator command provided by an operator control device, the method comprising:

providing a proportional control valve operatively connected to the hydraulic actuator;

providing an actuator valve operatively connected to the hydraulic actuator, the actuator valve including a fully closed position and a fully open position;

generating an operator command in response to an input received from the operator control device; and adjusting the proportional control valve in response to the operator command if the actuator valve is between the fully closed position and the fully open position and if operator command exceeds a predetermined threshold to provide a fluid flow between the rod end and the head end of the hydraulic actuator.

20. The method of claim 19 further comprising:

adjusting the actuator control valve in response to the operator command from a first position to a second position to move the hydraulic actuator; and wherein the operator command determines an actuator control valve command and the actuator control valve command determines a proportional control valve command used to adjust the proportional control valve.

* * * * *